US005154074A

United States Patent [19]

Haraguchi et al.

[11] Patent Number: 5,154,074

[45] Date of Patent: Oct. 13, 1992

[54] ROLL WITH WIDTH ADJUSTING FUNCTION

[75] Inventors: Tetsuro Haraguchi, Hyogo; Eiji Hirooka; Mitsuaki Watanabe, both of Nara, all of Japan

[73] Assignee: Sumitomo Metal Industries, Ltd., Osaka, Japan

[21] Appl. No.: 645,502

[22] Filed: Jan. 24, 1991

[30] Foreign Application Priority Data

Feb. 23, 1990 [JP] Japan ..... 2-17996
Feb. 23, 1990 [JP] Japan ..... 2-17997

[51] Int. Cl.[5] ..... B21B 31/18; F16D 11/06; F16D 3/80

[52] U.S. Cl. ..... 72/247; 72/252.5; 29/116.1; 29/130; 192/18 A; 403/37

[58] Field of Search ..... 72/195, 199, 225, 247, 72/252.5, 366.2; 29/110, 115, 116.1, 125, 130; 192/18 A; 403/15, 34, 37

[56] References Cited

U.S. PATENT DOCUMENTS

| | | | |
|---|---|---|---|
| 1,078,240 | 11/1913 | Barbour | 72/247 |
| 2,817,142 | 12/1957 | Boden et al. | 403/15 |
| 4,191,042 | 3/1980 | Salter, Jr. | 72/247 |
| 4,546,527 | 10/1985 | Fukuda et al. | 29/125 |
| 4,650,364 | 3/1987 | Kark | 403/34 |
| 4,748,729 | 6/1988 | Rochelmeyer | 29/125 |
| 4,966,026 | 10/1990 | Nishino | 72/366.2 |

FOREIGN PATENT DOCUMENTS

| | | | |
|---|---|---|---|
| A2346880 | 12/1989 | European Pat. Off. . | |
| 0072603 | 4/1985 | Japan | 72/247 |
| 0082209 | 5/1985 | Japan | 72/247 |
| 0017310 | 1/1986 | Japan | 72/247 |
| 0156007 | 7/1987 | Japan | 72/247 |
| 1-28642 | 5/1989 | Japan . | |
| 0317607 | 12/1989 | Japan | 72/247 |
| 1235088 | 6/1971 | United Kingdom | 403/15 |
| A2222796 | 3/1990 | United Kingdom . | |

*Primary Examiner*—Lowell A. Larson
*Assistant Examiner*—Thomas C. Schoeffler
*Attorney, Agent, or Firm*—Burns, Doane, Swecker & Mathis

[57] ABSTRACT

A rolling apparatus having a width adjustment function includes a horizontal sleeve roll divided into two rolls in the axial direction and shrink-fitted over an arbor. Internal threads are formed in the inner circumference of one of the divided sleeve rolls. The arbor includes fluid passages for loading a fluid under high pressure between the sleeve roll and the arbor. A width-adjusting sleeve is movably mounted over the axial end portion of the arbor and external threads for formed in the inner side portion of the width-adjusting sleeve. The external threads of the width-adjusting sleeve are threadedly engaged with the internal threads of the sleeve roll. A clutch mechanism fixes the width-adjusting sleeve in a fixed position when a roll width adjustment is performed.

22 Claims, 7 Drawing Sheets

ROLL WITH WIDTH ADJUSTING FUNCTION

BACKGROUND OF THE INVENTION

1. Field of the Invention

The present invention relates to a roll with a function of arbitrarily adjusting the width of a horizontal roll of a universal mill that is applicable to rolling H-steels or the like.

2. Statement of the Prior Art

A width-variable horizontal roll has already been disclosed in which the width of the roll can be adjusted in accordance with individual sizes of various types of H-steels to be rolled. Disclosed initially was a method of providing a shim between sleeve rolls that are divided into two, or a method of forming external and internal threads in the two sleeve rolls. However, with either of these two methods, a width adjusting operation had to be carried out off the rolling line, and a tremendous amount of time and labor was required to carry out such an operation.

As a method to solve the above drawback, the official gazette of Japanese Patent Publication No. 28642/1989 discloses a horizontal roll in which a hydraulic cylinder is interposed between a pair of left and right sleeve rolls for moving one of the sleeve rolls in the axial direction, and in which an injection channel is also provided for forming an oil film on the outer circumference of the movable sleeve roll and an arbor over which the movable sleeve roll is fitted in order to facilitate the movement of the movable sleeve roll by the hydraulic cylinder.

Although the latter method in which external and internal threads are formed in the two sleeve rolls enables the adjustment of the roll width by remote control of the horizontal roll while it is permitted to remain on the rolling line, since a hydraulic cylinder is used as a means for moving one of the rolls in the axial direction, it has a drawback that a complicated hydraulic pressure control device is required. On top of this, precise fine adjustment of hydraulic pressure is very difficult.

SUMMARY OF THE INVENTION

A main object of the present invention is to provide a roll in which fine adjustment of the width of the roll is possible through thread-fitting and screwing movement while the roll is permitted to remain on the rolling line.

Another object of the present invention is to provide a roll provided with a width-adjustment function in which the threaded portions are easy to be maintained, and in which the degree of accuracy with which the roll width is adjusted is improved by reducing clearances between the threaded portions.

A further object of the present invention is to provide a clutch device for a width-adjustable roll in which the width of the roll is automatically adjusted while the roll is permitted to remain on the rolling line, and in which the degree of accuracy at which the roll width is adjusted is improved by greatly lowering the index angle resolution and also by eliminating rotating phase difference between an arbor and a width-adjusting sleeve during a rolling operation, thereby making it possible to maintain the dimensional accuracy of H-steels to be produced.

A still further object of the present invention is to obtain a rotary joint for completely sealing in oil between the rotating and fixed portions of a roll without interfering with the smooth rotation of the roll.

In a roll with a width-adjustment function according to the present invention, a horizontal sleeve roll that is divided into two in the axial direction is fitted over an arbor by shrink-fitting, and a means is provided for reducing interference by loading a fluid under high pressure into the inner circumference of one of the divided sleeve rolls. Furthermore, internal threads are formed in the inner circumference of the same sleeve roll at one end thereof so that external threads formed in an inner side of a width-adjusting sleeve roll loosely fitted over the axial end portion of the arbor are screwed thereover, and a clutch mechanism is provided for fixing the width-adjusting sleeve to a chock when the width of the roll is adjusted.

In adjusting the width of the roll, the interference between the sleeve roll and the arbor is reduced through the means for loading a fluid under high pressure, and the sleeve roll is moved in a screwing fashion by revolving the arbor at a low speed by means of a dividing motor with the width-adjusting sleeve being connected to the chock, thereby making it possible to effect fine width adjustment while the roll is permitted to remain on the rolling line.

In a roll with a width-adjustment function according to one embodiment of the present invention, projecting pieces are provided at equal intervals on the outer circumferential surface of the proximal end portion of a movable sleeve roll, and are connected to the arbor by means of sliding keys. In addition, external threads are formed in the proximal end portion of the above-mentioned width-adjusting sleeve, and projecting pieces provided at equal intervals on the surface of an inner end of an adjusting nut screwed on the external threads are fitted in between the projecting pieces of the movable sleeve roll, whereby those projecting pieces are fixed together relative to the axial direction by means of divided keys.

In this embodiment, the projecting pieces are provided in such a manner as to project from the movable sleeve and the projecting pieces of the adjusting nut that are fitted in the former projecting pieces are integrally connected to each other in the axial direction. Therefore, in adjusting the width of the roll, the adjusting nut and the movable sleeve roll that rotates together with the arbor are moved in a screwing fashion as an integral part relative to the width-adjusting sleeve roll fixed to the chock side via the clutch mechanism, thereby enabling width adjustment with high accuracy. In addition, since the adjusting nut is made as an independent component, the nut is easy to be dismounted, and a sufficient area to maintain a certain grasping force between the arbor and movable sleeve roll is secured.

In a clutch mechanism for a width-adjusting roll according to another embodiment of the present invention wherein a horizontal roll for a rolling mill for H-steels is divided into two in the axial direction of the arbor with one or both of the rolls so divided being displaced in the axial direction, a first tooth clutch for connecting the arbor with the width-adjusting sleeve is provided between an arbor end key secured to an axial end of the arbor and an armature loosely fitted over the width-adjusting sleeve via the sliding key that is in turn loosely fitted over the arbor, and a second tooth clutch for locking the width-adjusting sleeve is provided between the armature and the clutch base. Furthermore, a spring is provided which acts to bias the first tooth clutch so as to be brought into meshing engaged connection thereof, and a hydraulic cylinder with a roller is provided that acts to release the first tooth clutch from the meshingly engaged connection and instead to bring the second tooth clutch in a meshingly engaged connection.

In this embodiment, during a rolling operation, the armature is pressed outwardly by virtue of the biassing force of the spring so as to be brought into meshing engagement with the first tooth clutch, whereby the rotating force of the arbor is transferred to the width-adjusting sleeve, thereby eliminating relative displacement between the arbor and sleeve. In addition, in adjusting the width of the roll, the armature is moved inwardly against the biassing force of the spring by actuating the hydraulic cylinder with a roller so as to release the first tooth clutch from the meshingly engaged connection while instead bringing the second tooth clutch in meshingly engaged connection, whereby the width-adjusting sleeve and the clutch base are made integral, thereby making it possible to put the arbor and sleeve in a released state. In other words, a change of roll width due to the occurrence of a rotating phase difference between the arbor and the width-adjusting sleeve may be prevented during a rolling operation, thereby making it possible to maintain a high degree of width accuracy of H-steels to be produced.

Moreover, the width-adjusting sleeve is fixed to the chock by changing over the meshing engagement by the first tooth clutch to that of the second tooth clutch, thereby making it possible to effect automatic on-line roll-width adjustment.

In a rotary joint for a width-adjusting roll according to a further embodiment of the present invention wherein a horizontal roll for a rolling mill for H-steel is divided into two in the axial direction and is shrink-fitted over the arbor, a pressurized oil being introduced from an external hydraulic device into a hydraulic passageway formed in the arbor so that the horizontal roll may mechanically be moved in the axial direction after the shrink-fit grasping force between the arbor and the horizontal roll is released, a recessed portion is formed in an axial end surface of the arbor, and a shaft, which is provided with a hydraulic passageway formed therein in such a manner as to communicate with the hydraulic passageway formed in the arbor, is fixed to the center of the recessed portion. In addition, a cylindrical fixed block having a hydraulic passageway formed therein in such a manner as to communicate in turn with the hydraulic passageway in the shaft is mounted in the recessed portion in such a manner that relative rotation thereof is permitted, and a plurality of distance pieces are axially movably mounted in an annular gap defined between the inner circumferential surface of the fixed block and the outer circumference of the shaft, whereby the vicinity of the portion where the hydraulic passageways of the fixed block and shaft are connected to each other is sealed by means of the distance pieces that are axially moved when a hydraulic pressure is applied.

In this embodiment, since the rotary joint serves, at the time of width adjustment, to load a fluid under high pressure not only between the sleeve and arbor but also into the hydraulic cylinder for changing over the clutch for the fixing device, a function to connect the rotating portion with the fixed portion in a smooth fashion while sealing in a fluid under high pressure is required. In addition, the rotary joint also functions as a joint portion for transferring the rotating position of the arbor to a distant position. The shaft is fixed to the inside of the axial end of the arbor by means of a flange, and block via pins so that they are prevented from rotating together with the arbor. Since the fixed block is fixed to the chock, the block does not rotate both at the times of rolling and adjusting the width of the roll. The distance pieces are fixed to the shaft by means of a key.

In adjusting the width of the roll, when a hydraulic pressure is applied, the back of the distance pieces are pressed by virtue of hydraulic pressure so applied, and they each contact the flange side and the other distance pieces, whereby mechanical sealing is effected via the contact surface. Since a high pressure in the range of 500–900 kg/cm$^2$ is applied, the back area of the distance piece is made as small as possible so as to reduce a force applied to the sliding surface. In addition, giving full consideration to the sealing performance, smooth rotation is designed to be effected both at the times of adjusting the width of the roll and rolling.

The present invention is constructed such that the fixed and rotating portions smoothly operate while fully functioning both at the times of rolling and adjusting the roll width. At the time of adjusting the roll width, a sealing function is provided by effecting contacts between the distance pieces and the flange, as well as between the distance pieces themselves by virtue of high pressure while smoothly rotating.

At the time of rolling, since a hydraulic pressure is not applied, sealing between the portions described above is not needed, and since there is a gap, smooth rotations may be possible.

DETAILED DESCRIPTION OF THE PREFERRED EMBODIMENTS

Figure 1:
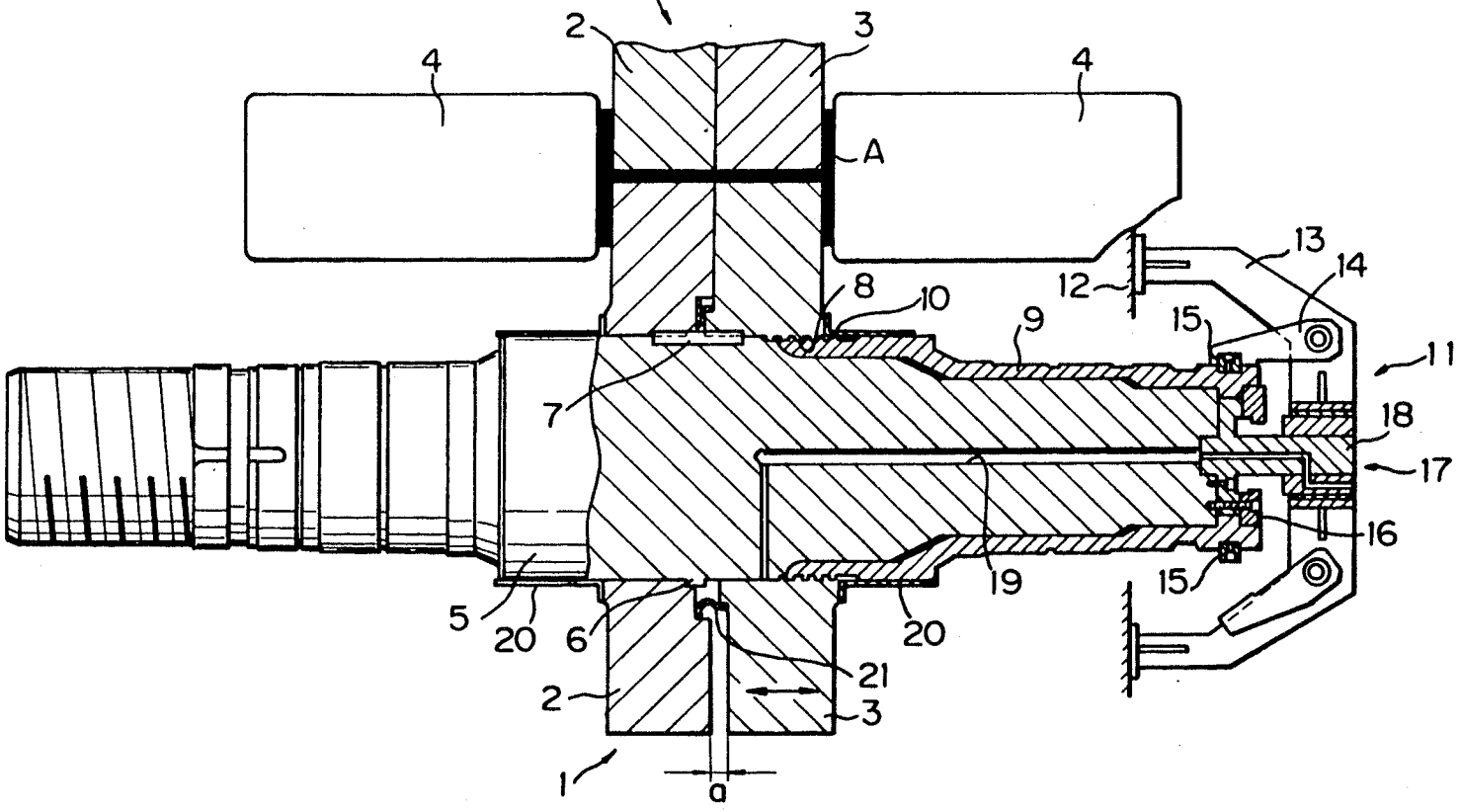
FIG. 1 is a front view, partly in vertical section, showing one embodiment of a roll according to the present invention.

Referring to the drawings, embodiments of a roll according to the present invention will be described.

Figure 2:
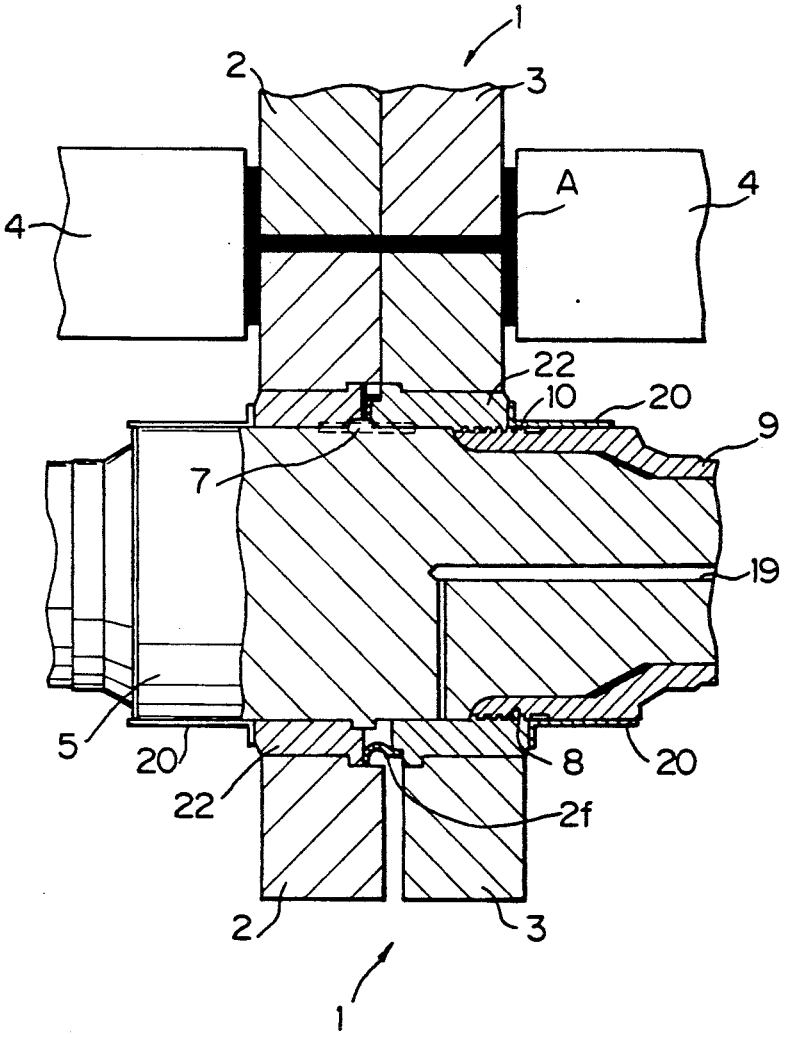
FIG. 2 is a front view, partly in vertical section, showing another embodiment of the present invention.
Figure 3:
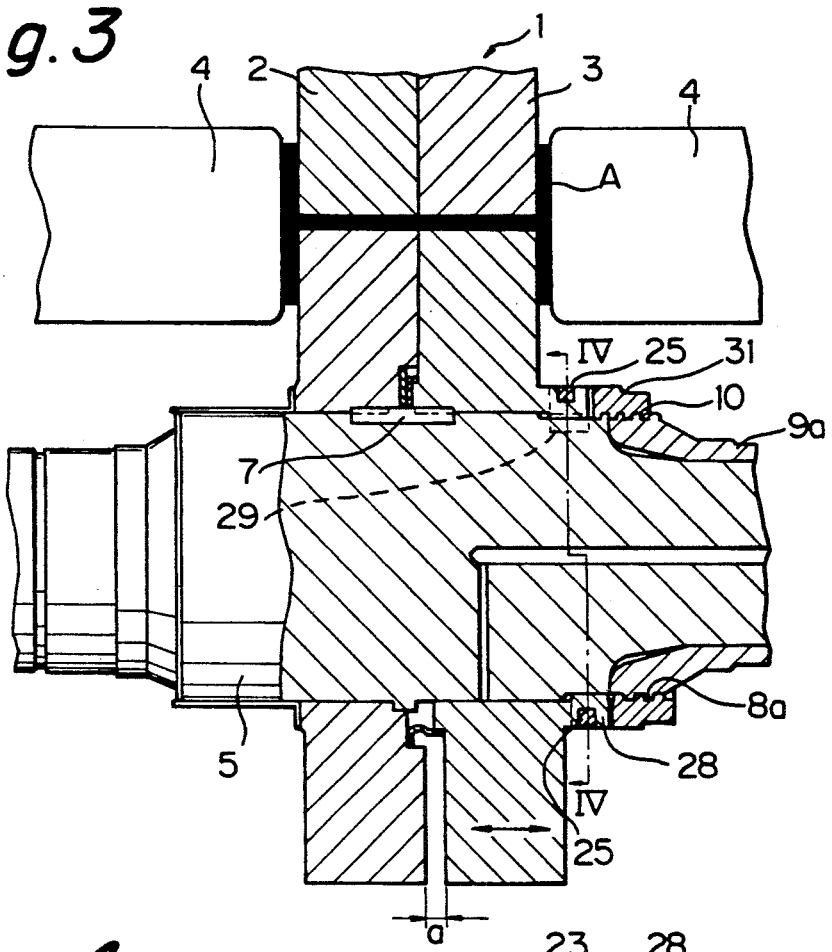
FIG. 3 is a vertical sectional view showing a further embodiment of the present invention.
Figure 4:
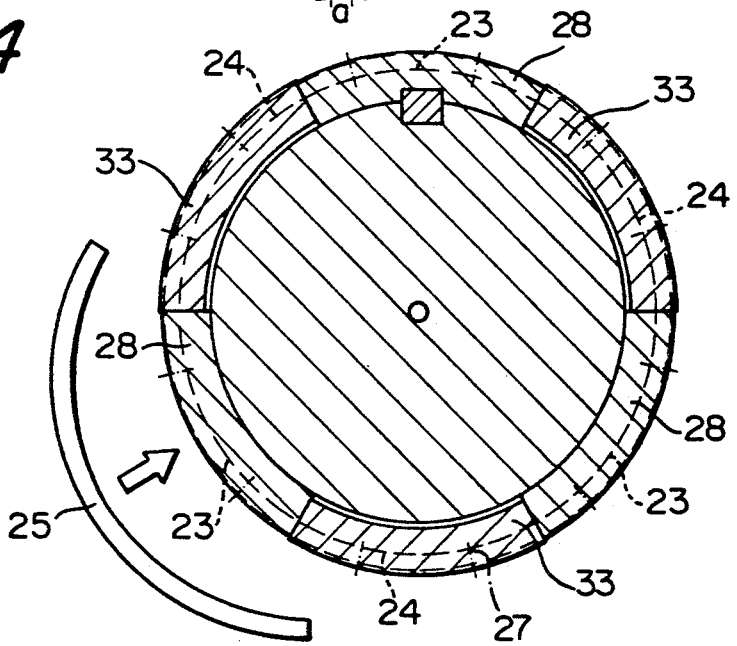
FIG. 4 is a cross-sectional view taken along the line IV—IV of FIG. 3.
Figure 5:
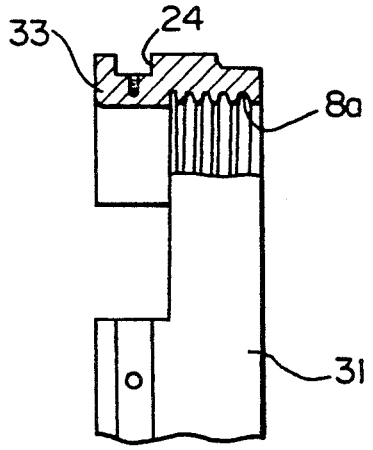
FIG. 5 is a partially sectional view of an adjusting nut.
Figure 6:
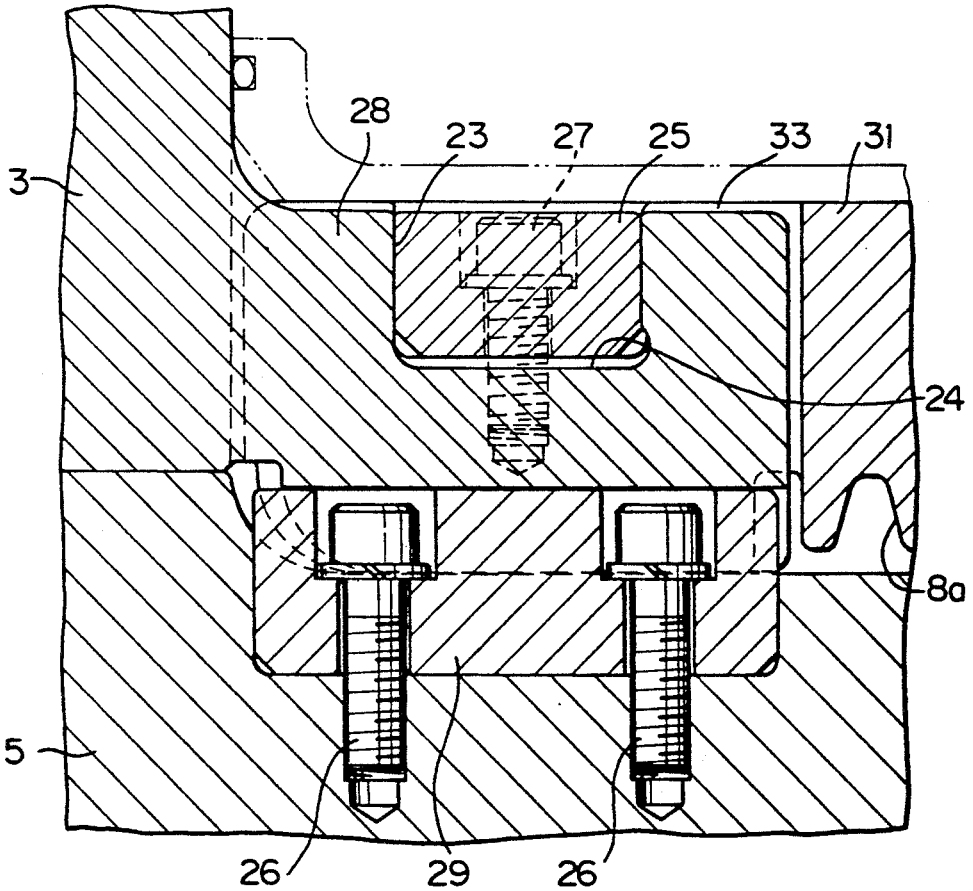
FIG. 6 is an enlarged vertical sectional view showing the main part.

First, referring to FIGS. 1 and 2, reference numeral 1 denotes a horizontal roll divided into a fixed sleeve roll 2 and a movable sleeve roll 3, and an H-steel A, a material to be rolled, is rolled into predetermined dimensions by means of the horizontal rolls 1 vertically confronting each other and vertical rolls 4.

The fixed sleeve roll 2 and movable sleeve roll 3 are both shrink-fitted in an arbor 5, and although a sufficient grasping force required for rolling is maintained, in order to further improve the grasping force in the axial direction, the fixed sleeve roll 2 side is fixed to the arbor 5 via a shoulder 6 provided on the arbor 5, and the movable side is supported on the thrust bearing portion of a width-adjusting sleeve, which will be described later. When necessary, a key 7 is fitted between the two sleeve rolls 2, 3 and the arbor 5, which, as will be described later, ensures positive rotation of the movable sleeve roll 3 when the width of the roll is adjusted.

Reference numeral 8 denotes internal threads formed in the inner circumference of the movable sleeve roll 3 at one end thereof, and these internal threads are fitted in a screwing fashion over external threads 10 formed on an inner side portion of the width-adjusting sleeve 9 loosely fitted over the axial end portion of the arbor 5.

Reference numeral 11 denotes a clutch mechanism to be fixed on the side of the width-adjusting sleeve 9 where a chock 12 is present, and this clutch mechanism 11 comprises a connecting member main body 13, engagement pawls 14 each pivotally secured to the connecting member main body 13 at the proximal portions thereof, and locking projecting pieces 15 with which the engagement pawls 14 are brought into locking contact. The clutch mechanism is designed to function only when the roll width is adjusted, and at other times, in other words, when rolling, the engagement pawls 14 are evacuated outside. Therefore, although not shown, an operating means for rotatably operating the engagement pawls 14 about the pivotally secured portion as a fulcrum is provided on the engagement pawls 14.

Reference numeral 16 denotes a thrust bearing portion for joining the outer end portion of the width-adjusting sleeve 9 to the end surface of the arbor 5.

Reference numeral 17 denotes a fluid loading means, which comprises a rotary joint for controlling connection to an external supply source of fluid under high pressure and a communicating hole 19 formed inside the arbor 5 and extending into the inside of the movable sleeve roll 3. This communicating hole 19 serves not only to reduce the interference between the movable sleeve roll 3 and the arbor 5 to thereby facilitate the screwing movement of the internal and external threads 8, 10 but also to restore the original grasping force of the movable sleeve roll 3 by stopping loading of a fluid under high pressure during a rolling operation.

In the drawing, reference numeral 20 denotes a dust cover, reference numeral 21 a dust seal, and reference character "a" denotes a distance by which the movable sleeve roll 3 is allowed to move.

Since a cast steel/cast iron roll made from a material containing 1–4% of carbon is used as the horizontal roll 1 from the viewpoint of wear characteristics, the strength of the horizontal roll is lowered, and in order to compensate for this inferior strength, as shown in FIG. 2, an intermediate sleeve 22 made from a forged steel may be interposed between the horizontal roll 1 and the arbor 5, and the respective joint portions are fixed to each other by virtue of shrink fit.

As is described above, when adjusting the width of the roll according to the present invention, a fluid under high pressure is loaded between the movable sleeve roll 3 and the arbor 5 by means of the fluid loading means in a state in which the width adjusting-sleeve 9 is first fixed to the chock 12 side by means of the clutch mechanism so as to reduce the interference by shrink fit, and the movement of the movable sleeve roll 3 is adjusted by rotating the arbor 5 at a low speed by means of a driving motor.

As is explained above, in accordance with the present invention, the internal and external threads 8, 10 formed in the movable sleeve roll 3 and the width-adjusting sleeve 9, respectively, are fitted to each other in a screwing fashion, and there are provided the clutch mechanism 11 for fixing the width-adjusting sleeve 9 to the chock 12, and the fluid loading means 17 for loading a fluid under pressure into the inner circumference of the movable sleeve roll 3 so as to reduce the interference relative to the arbor 5. In this construction, since the width of the roll is adjusted through the fine and positive movement of the threads generated when they are moved in a screwing fashion, it is possible to easily carry out width adjustment with a high degree of accuracy so that a material is rolled into desired dimensions while the roll is permitted to remain on the rolling line, and this greatly contributes to reduction of time needed to change the width of the roll and the number of rolls to be possessed.

However, in the structure shown in FIGS. 1 and 2, since the internal threads 8 formed in the inner surface of the movable sleeve roll 3 and the external threads 10 formed in the outer circumference of the end of the width-adjusting sleeve 9 are fitted in each other in a screwing fashion, the following drawbacks are encontered with the structure: the shrink fit portion of the movable sleeve roll 3 relative to the arbor 5 becomes extremely short, and therefore it is not possible to maintain full grasping force; it is difficult to maintain the thread portions 8, 10; and since the thread portions 8, 10 are subject to deflection due to shrink-fit, it is necessary to take a wide clearance between the respective threads.

Another embodiment illustrated in FIGS. 3–6 solves the above-mentioned problems.

Reference numeral 28 denotes a plurality of projecting pieces provided on the outer circumferential surface of the proximal end portion of the movable sleeve roll 3 in such a manner as to be brought into contact with the circumferential surface of the arbor 5 in a precise manner. These projecting pieces 28 are provided circumferentially at equal intervals, and are connected to the arbor 5 with sliding keys 29.

Refence numeral 31 denotes an adjusting nut having internal threads 8*a* formed thereinside, which are fitted in a screwing fashion over external threads 10 formed in the proximal end portion of a width-adjusting sleeve 9*a*, and a plurality of circumferentially equidistant projecting pieces 33 that are to be fitted in between the aforementioned plurality of projecting pieces 28 provided on the movable sleeve roll 3 side are provided on the front half portion of this adjusting nut 31.

Grooves 23, 24 are formed in the circumferential surface of the central portion of the respective projecting pieces 28, 33 in such a manner that the respective grooves 23, 24 become continuous, and divided keys 25 extending around the two grooves 23, 24 are fitted in those grooves, thereby joining the two groups of projecting pieces 28, 33 together. In the others words, the movable sleeve roll 3 and the adjusting nut 31 are made integral relative to the axial direction by means of the divided keys 25, and they are also circumferentially made integral by virtue of fitting engagement between the projecting pieces 28, 33. In the drawings, reference numeral 26 denotes a bolt for fixing the sliding key 29 to the arbor 5, and reference numeral 27 denotes a bolt for fixing the divided key 25 to the projecting pieces 28, 33.

The adjusting nut 31 may be dismounted together with the width-adjusting sleeve 9*a* by removing the divided keys 25, and furthermore the nut may also be dismounted from the width-adjusting sleeve 9*a*.

Although not shown in the drawings, since the sleeve roll is made from cast steel/cast iron, the strength of the roll is lowered, and therefore, an intermediate sleeve 22 made from a forged steel (FIG. 2) may be interposed between the sleeve roll and the arbor. In this case, the projecting pieces are provided on the outer surface of the intermediate sleeve that is on the side of the movable sleeve roll in such a manner as to project therefrom.

In accordance with the above-described embodiment, the projecting pieces 28 are provieded on the outer circumferential surface of the proximal end portion of the movable sleeve roll 3, and the projecting pieces so provided are then connected to the arbor 5 via the sliding keys 29, and the projecting pieces 33 provided on the adjusting nut 31 fitted in a screwing fashion over the external threads 10 formed in the proximal end portion of the width-adjusting sleeve 9*a* are fitted between the projecting pieces 28 provided on the movable sleeve roll 3 with these projecting pieces 28, 33 being fixed relative to the axial direction by means of the divided keys 25. In this construction, since the thread-fitted portion where the width-adjustment function is perfomed exists outside the surface where the movable sleeve roll 3 is fitted in the arbor 5, there is no risk of the grasping force between the two members being lost, and moreover, since the thread portions 8*a*, 10 are free from the influence of shrink fit, a clearance between the respective threads may be determined as small as possible, thereby making it possible to improve the degree of width adjusting accuracy. In addition, the adjusting nut 31 is an independent component, and therefore, the nut may be dismounted, thereby facilitating exchange and maintenance thereof.

Furthermore, in the embodiment shown in FIG. 1 and 2, the arbor 5 and the width-adjusting sleeve 9 are tightly fitted together at the axial end of the arbor 5 by means of the bolt 16 in order to prevent occurrence of angular phase difference relative to the members due to the generation of rotating force of the width-adjusting sleeve 9 during a rolling operation. Since the arbor 5 and the width-adjusting sleeve 9 are joined together via the threads 8, 10, this angular phase difference eventually changes the width of the roll. In order to deal with this phenomenon, the two members have to be fixed to each other by means of meshingly engaging elements that are free from slips during a rolling operation, and furthermore, these fixing elements also have to have resolution allowing themselves to be meshingly engaged and/or released at any rotating angles.

Next, the width-adjusting sleeve 9 is fixed to the chock 12 during a width-adjusting operation, and as in the case of the rolling operation above, when fixed, the two members have to be fixed to each other by means of meshingly engaging elements at any rotating angles.

Figure 7:
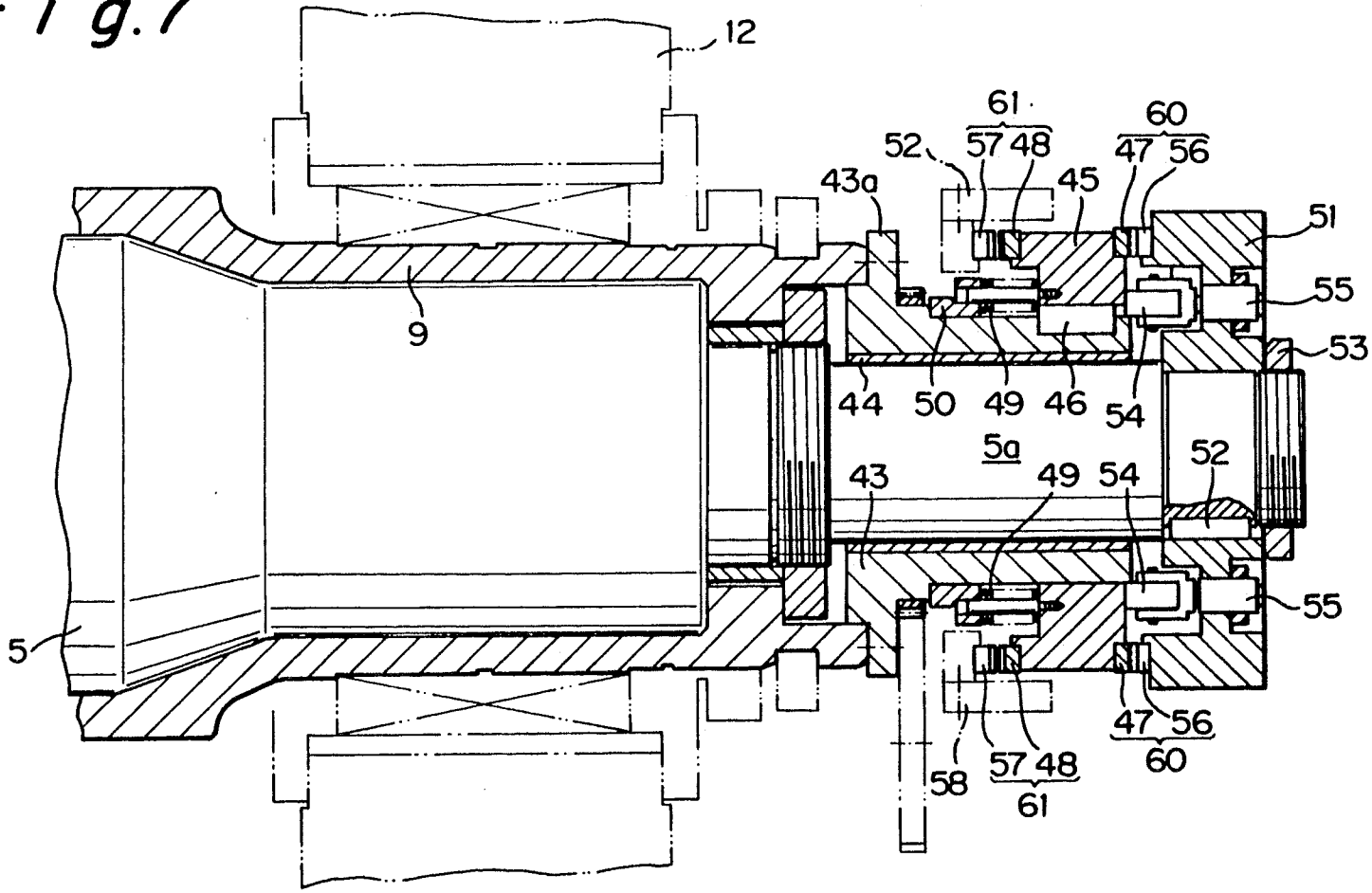
FIG. 7 is a vertical sectional view showing another embodiment of a clutch mechanism.

An embodiment shown in FIG. 7 suffices the above requirements. In this embodiment, reference numeral 43 denotes a sleeve end fitted over the thinner shaft portion 5*a* of the arbor 5 via a bush 44, and is fixed to the end of the width-adjusting sleeve 9 at the flange portion 43*a* thereof. Reference numeral 45 denotes an armature, which is fitted over the outer end portion of the sleeve end 43 via sliding key 46 in such a manner as to displace in the axial direction. This armature 45 has tooth clutch pieces 47, 48 mounted thereon at the outer circumferential end edge portions by means of bolts and knock pins (not shown).

Reference numeral 49 denotes a belleville spring, which is interposed between the armature 45 and a spring shoe 50 for biassing the armature 45 outwardly by virtue of resilient pressure thereof. Reference numeral 51 denotes an arbor end, which is fitted over the end of the arbor 5 and is fixed thereat by means of a key 52 and a nut 53. A plurality of hydraulic cylinders 55 each having a roller 54 that is brought into contact with the outside of the armature 45 to thereby be rolled are received and fixed in the arbor end 51, and a tooth clutch piece 56 is fixed to the circumferential surface of an inner end of the arbor end 51 at a position confronting to the tooth clutch piece 47.

Reference numeral 57 denotes a tooth clutch piece fixed to a clutch base 58, which is a member integral to the chock 12. In others words, a first tooth clutch 60 is constituted by the tooth clutch pieces 47, 56 confronting each other, and a second tooth clutch 61 is constituted by the clutch pieces 48, 57.

Next, the roll width adjustment and maintenance of the dimensions of an H-steel during a rolling operation in accordance with the above-mentioned structure will be described. It should be noted, however, that in this case the width-adjusting sleeve 9 is fixed, while the arbor 5 is rotated when the width of the roll is adjusted.

In others words, as shown in FIG. 7, the armature 45 is outwardly biassed by means of the belleville spring 49 so that the first tooth clutch 60 is brought into meshing engagement in other states than one in which the width of the roll is adjusted. This meshing engagement of the first tooth clutch 60 makes the arbor 5 and the width-adjusting sleeve 9 integral, whereby the axial displacement of the movable sleeve roll is prevented, thereby making it possible to maintain the dimension accuracy for an H-steel.

When the width of the roll is adjusted, oil under high pressure is sent through the axial core of the arbor so as to release the roll shrink fit force. If, in synchronism with this, oil under high pressure is also sent into the hydraulic cylinders 55 accommodated in the arbor end 51, the armature 45 moves inwardly against the biassing force of the belleville spring 49, when the first tooth clutch 60 is released from the meshing engagement with the second tooth clutch 61 being instead brought into meshing engagement. In this state, the width-adjusting sleeve 9 is integrally fixed to the chock 12 side, and if, in this state, a rotating force is transferred to the arbor 5, the movable sleeve roll 3 may be displaced in the axial direction. A thrust force generated between the armature 45 and the arbor end 51 while rotating is borne by the rollers 54. When a predetermined amount of width adjustment has been completed, the armature is restored to the position shown in FIG. 7 by discharging oil under high pressure, and the first tooth clutch 60 is then brought back into meshing engagement.

In the embodiment shown in the drawing, although the clutch mechanism is provided only on one side of the arbor, the clutch mechanism may be provided at either end of the arbor.

In accordance with the above embodiment, while a rolling operation is perfomed, the first tooth clutch 60 is kept in meshing engagement by means of the armature that is moved by virtue of the biassing force of the spring so that the arbor 5 and width-adjusting sleeve 9 are made integral. In contrast, when the width of the roll is adjusted, the second tooth clutch 61 is instead brought into meshing engagement by means of the armature that is this time moved against the biassing force of the spring so that the width-adjusting sleeve 9 and clutch base 58 are made integral, while the arbor 5 and the width-adjusting sleeve 9 are released from the integral state. Thus, it is possible not only to maintain the roll width with a high degree of accuracy but also to effect roll width adjustment while the roll is permitted to remain in the rolling line.

As described above, the hydraulic system for releasing the shrink-fit grasping force comprises the rotating and fixed portions. A rotary joint is required not only to effect perfect oil sealing of the portion in the roll where the rotating and fixed portions are connected to each other but also to eliminate interference to the smooth rotation of the roll.

Figure 8:
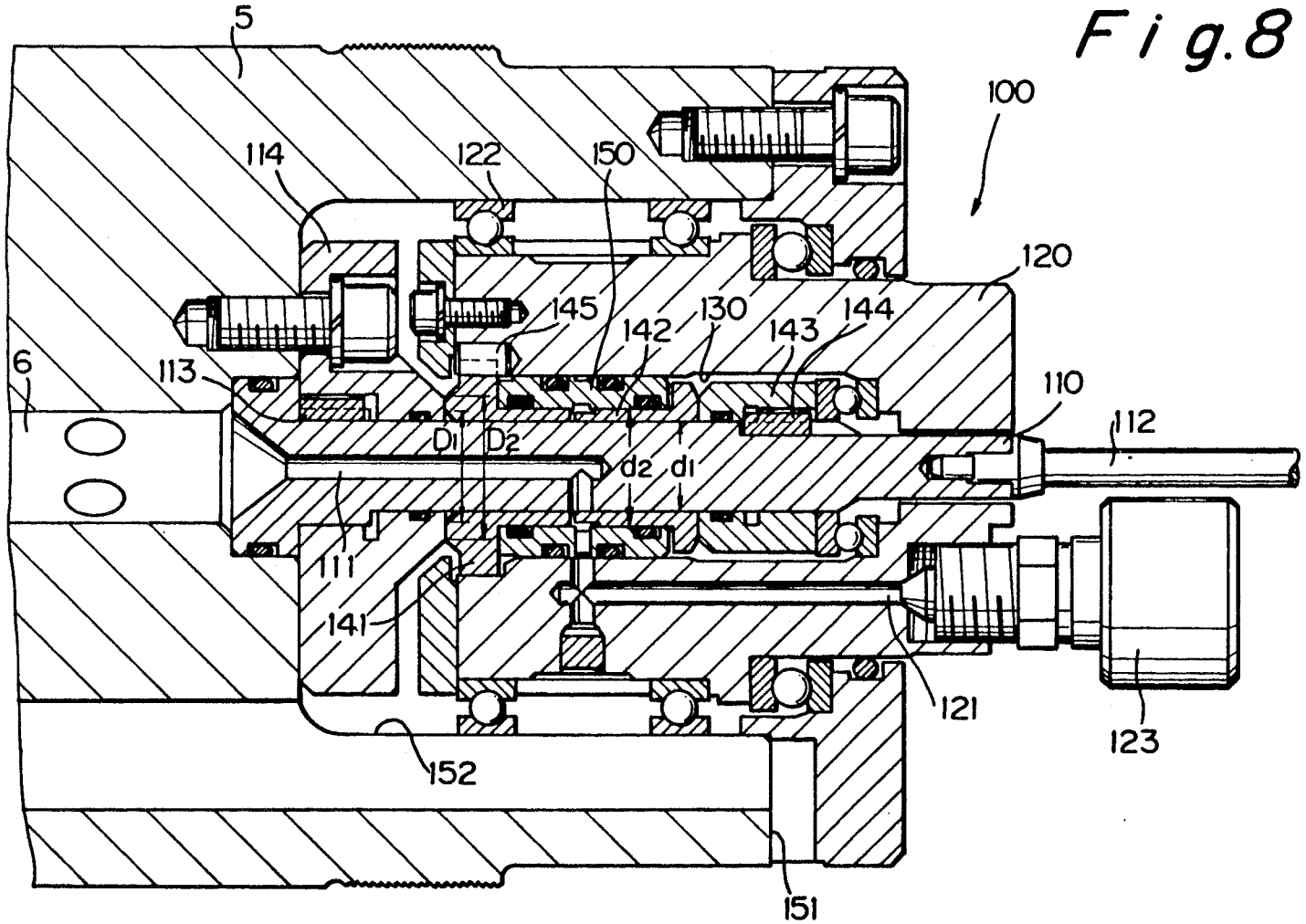
FIG. 8 is a vertical sectional view showing one embodiment of a rotary joint for use with the roll according to the present invention.
Figure 9:
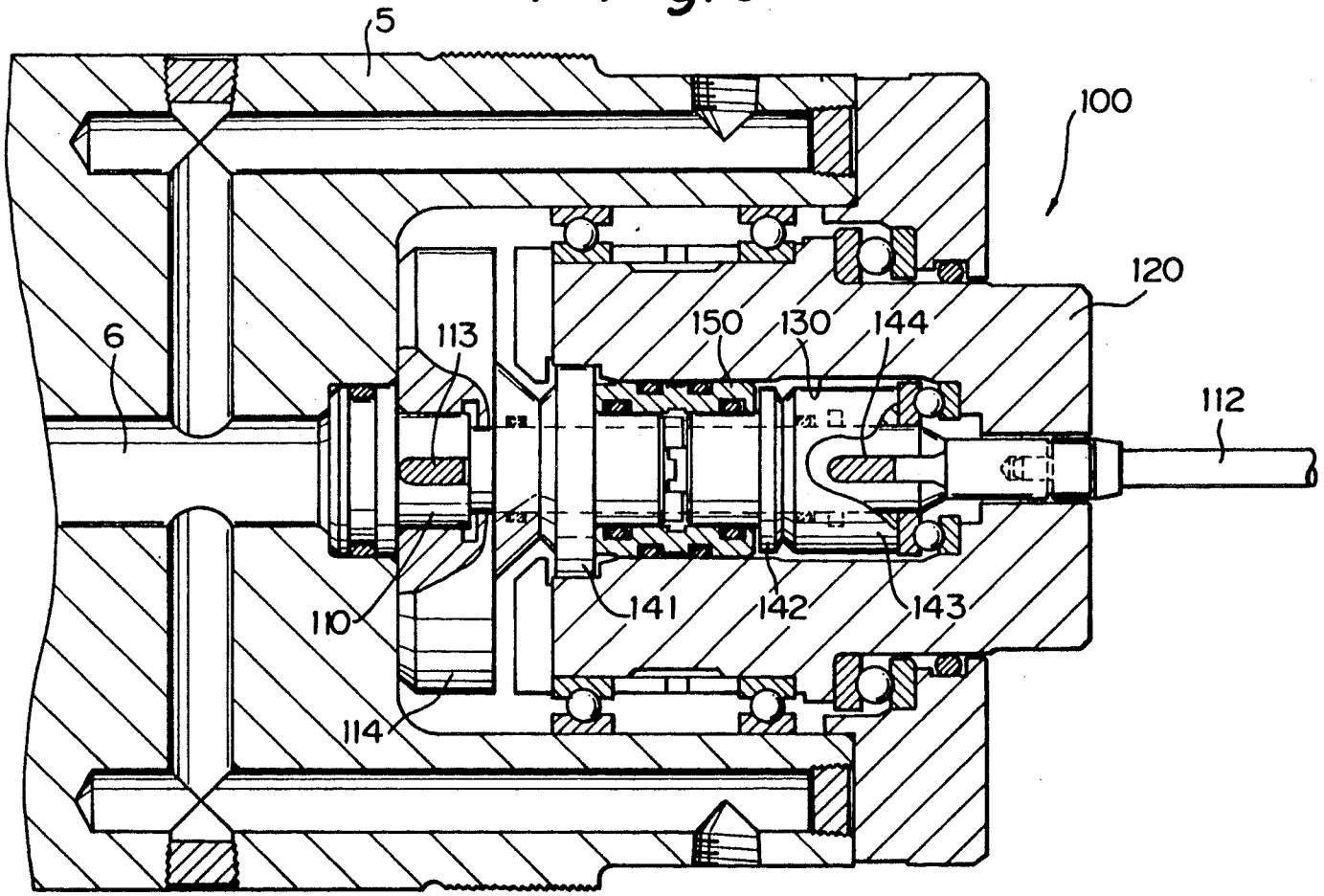
FIG. 9 is a plan view of FIG. 8.

An embodiment shown in FIGS. 8 and 9 discloses a rotary joint satisfying the above requirements.

First, as shown in FIG. 8, the roll on which a rotary joint 100 according to the present invention is constructed such that the horizontal roll for a rolling mill for H-steels is divided into two in the axial direction and are shrink-fitted over the arbor 5, that pressurized oil from the external hydraulic device (not shown) is introduced into the hydraulic passageway 6 formed inside the arbor 5, and that the horizontal roll is mechanically (for instance, by means of a thread mechanism) moved in the axial direction after the shrink-fit grasping force between the arbor 5 and the horizontal roll is released.

As shown in FIGS. 8 and 9, in the rotary joint 100 according to the present invention that may be used with a roll as above, a recessed portion 152 is provided in an axial end face 151 of the recessed portion 152. A shaft 110 is fixed to the recessed portion 152 at the center thereof, and a hydraulic passageway 111 is formed inside the shaft 110 in such a manner as to communicate with the hydraulic passageway 6 formed in the arbor 5. A cylindrical fixed block 120 having a hydraulic passageway 121 formed therein in such a manner as to communicate with the hydraulic passageway 111 is relatively rotatably installed in the recessed portion 152 via a bearing 122. A plurality of distance pieces 141, 142, 143 are axially movably installed in an annular gap 130 defined between the inner surface of the fixed block 120 and the outer circumference of the shaft 110. The vicinity of the portion where the fixed block 120 and the hydraulic passageway 111 of the shaft 110 are hermetically sealed is where the distance pieces 141 and 142 are moved in the axial direction when hydraulic pressure is loaded.

The end portion of the shaft 110 is connected to a synchro transmitter via a flexible shaft 112. The hydraulic passageway 121 of the fixed block 120 is connected to an external hydraulic device via a coupler 123.

Next, the above-mentioned structure will be described in detail.

In FIGS. 8 and 9, the shaft 110 is fixed to the arbor 5 by means of a key 113 flange. The flexible shaft 112 for enabling the detection of rotating position of the arbor 5 at a distant point is connected to the shaft 110. The distance pieces 141, 142, 143 are loosely fitted around the shaft 110. The distance piece 143 is circumferentially fixed by means of a key 144, and the distance piece 141 is fixed to the fixed block 120 and relative to the circumferential direction by means of a pin 145 (FIG. 8). A cylindrical retainer 150 is disposed between distance pieces 141, 142 and the fixed block 120. Since the fixed block 120 is connected to a hydraulic device (not shown) by means of a hydraulic coupler, it is fixed to the chock. Therefore, hydraulic pressure is not loaded while rolling, and since there is a gap between the distance pieces 141, 142, 143 functioning as a contact sliding surface and the shaft 110, the distance piece 141 and the flange 114, and the distance piece 141 and the distance 142, respectively, the respective members do not fully contact each other, and smooth rotations are possible.

In contrast, when adjusting the width of the roll, a fluid under high pressure is loaded, and the back of the distance pieces 141 and 142 are pressurized. Since this causes the flange 114 and distance piece 141 to contact each other with a force of $F=\pi/4\,(d_2^2-D_1^2)\times P$ (pressure), a sliding resistance is generated. If this resistance is great, the fixed block 120 is also caused to rotate. Due to this, the dimensions $d_1$, $d_2$, $D_1$, $D_2$ of the distance pieces 141 and 142 are designed such that the sliding resistance becomes as small as possible while maintaining the sealing properties.

In accordance with the above embodiment, it is possible to connect the fixed portion with the rotating portion in a smooth fashion while bearing a fluid under high pressure of 500 to 900 kg/cm$^2$ and maintaining its sealing properties.

While the invention has been described with reference to the foregoing embodiments, various changes and modifications can be made thereto which fall within the scope of the claims.

What is claimed is:

1. A rolling apparatus comprising:

an arbor extending in an axial direction and rotatable about a rotation axis parallel to the axial direction;

an adjustable sleeve roll comprising first and second sleeve rolls shrink-fitted over the arbor, the first sleeve roll being movable in the axial direction and including first threads formed on an axial end thereof; fluid loading means for loading a fluid under high pressure between the first sleeve roll and the arbor;

a width-adjusting sleeve fitted over an axial end portion of the arbor, the width-adjusting sleeve being freely rotatable with respect to the arbor and including second threads threadedly engaged with the first threads of the first sleeve roll;

a clutch mechanism for fixing the width-adjusting sleeve in a fixed position relative to the arbor when a roll width adjustment is performed by rotating the arbor to move the first sleeve roll axially along the arbor due to engagement of the first threads of the first sleeve roll with second threads of the width-adjusting sleeve; and a rotary joint, the rotary joint including a recessed portion in an axial end surface of the arbor, a shaft mounted in the recessed portion at a center thereof, a first hydraulic passageway inside the shaft, a second hydraulic passageway in the arbor and communicating with the first hydraulic passageway in the shaft, the second hydraulic passageway communicating with fluid loading means, a block mounted in the recessed portion of the arbor such that the arbor is rotatable with respect to the block, a third hydraulic passagway in the block and communicating with the first hydraulic passageway in the shaft, an annular gap between an inner surface of the block and an outer circumference of the shaft, and hermetic seal means in the annular gap for providing a hermetic seal between the shaft and the block when hydraulic fluid pressure is applied to the first, second and third hydraulic passageways. to 2. The rolling apparatus of claim 1, wherein the first threads of the first sleeve roll are internal threads formed in an inner circumference of the axial end thereof and the second threads of the width-adjusting sleeve are external threads, the first sleeve roll being keyed to the arbor so as to be rotatable therewith but movable in the axial direction when the width-adjusting sleeve is in the fixed position.

3. The rolling apparatus of claim 1, wherein each of the sleeve rolls includes an intermediate sleeve made from a forged steel interposed between the respective sleeve roll and the arbor.

4. The rolling apparatus of claim 1, wherein the shaft is fixedly mounted in the recessed portion such that the arbor and the shaft are not rotatable independently of each other.

5. The rolling apparatus of claim 1, wherein the block includes an inlet for supplying hydraulic fluid to the third hydraulic passageway.

6. The rolling apparatus of claim 1, wherein the first sleeve roll includes first projecting pieces extending in the axial direction from the axial end of the first sleeve roll, the first projecting pieces being separated by spaces which extend in a circumferential direction around the arbor, the first sleeve roll including an adjusting nut on which the first threads are provided, the first threads being threadedly engaged with the second threads of the width-adjusting sleeve, the adjusting nut including second projecting pieces extending in the axial direction, the second projecting pieces filling the spaces between the first projecting pieces, and circumferentially extending keys connecting the first and second projecting pieces together such that adjusting nut and first sleeve roll move in the axial direction during adjustment of the first sleeve roll.

7. The rolling apparatus of claim 1, wherein the hermetic seal means comprises a plurality of distance pieces mounted in the annular gap and movable in the axial direction, the distance pieces being moved in the axial direction when hydraulic fluid pressure is applied to the first, second and third hydraulic passageways.

8. The rolling apparatus of claim 7, wherein the distance pieces include first and second tubular distance pieces adjacent to each other and surrounding the shaft, the hermetic seal means further including a tubular retainer in the annular gap and surrounding adjacent portions of the first and second distance pieces.

9. A rolling apparatus comprising:

an arbor extending in an axial direction and rotatable about a rotation axis parallel to the axial direction;

an adjustable sleeve roll comprising first and second sleeve rolls shrink-fitted over the arbor, the first sleeve roll being movable in the axial direction and including first threads on an axial end thereof;

fluid loading means for loading a fluid under high pressure between the first sleeve roll and the arbor;

a width-adjusting sleeve fitted over an axial end portion of the arbor, the width-adjusting sleeve being freely rotatable with respect to the arbor and including second threads threadedly engaged with the first threads of the first sleeve roll; and a clutch mechanism for fixing the width-adjusting sleeve in a fixed position relative to the arbor when a roll width adjustment is performed by rotating the arbor to move the first sleeve roll axially along the arbor due to engagement of the first threads of the first sleeve roll with the second threads of the width-adjusting sleeve;

the clutch mechanism including a first tooth clutch for connecting the arbor to the width-adjusting sleeve so as to be rotatable therewith and a second tooth clutch for locking the width-adjusting sleeve in the fixed position, the first tooth clutch being mounted on the arbor and the second tooth clutch being fixedly mounted, the clutch mechanism further including an armature slidably mounted on the width-adjusting sleeve so as to be movable in the axial direction and engagable with either the first tooth clutch or the second tooth clutch, a first mechanism biassing the armature into engagement with the first tooth clutch and a second mechanism which moves the armature out of engagement with the first tooth clutch and into engagement with the second tooth clutch.

10. The rolling apparatus of claim 9, wherein the first threads of the first sleeve roll are internal threads formed in an inner circumference of the axial end thereof and the second threads of the width-adjusting sleeve are external threads, the first sleeve roll being keyed to the arbor so as to be rotatable therewith but movable in the axial direction when the width-adjusting sleeve is in the fixed position.

11. The rolling apparatus of claim 9, wherein the armature is mounted to the width-adjusting sleeve such that the armature and the width-adjusting sleeve are not rotatable independently of each other.

12. The rolling apparatus of claim 9, wherein the first mechanism comprises spring means compressed between a spring shoe mounted on the width-adjusting sleeve and a side of the armature opposite to a side of the armature facing the first tooth clutch.

13. The rolling apparatus of claim 9, wherein an axially extending key mounted on the width-adjusting sleeve is slidably received in a recess in the armature.

14. The rolling apparatus of claim 9, wherein each of the sleeve rolls includes an intermediate sleeve made from a forged steel interposed between the respective sleeve roll and the arbor.

15. The rolling apparatus of claim 9, wherein the second mechanism comprises hydraulically actuated means for axially moving the armature out of engagment with the first tooth clutch and into engagement with the second tooth clutch.

16. The rolling apparatus of claim 15, wherein the hydraulically actuated means comprises a plurality of hydraulic cylinders, each of which includes a roller in rolling engagement with a surface of the armature.

17. The rolling apparatus of claim 9, further comprising a rotary joint, the rotary joint including a recessed portion in an axial end surface of the arbor, a shaft mounted in the recessed portion at a center thereof, a first hydraulic passageway inside the shaft, a second hydraulic passageway in the arbor and communicating with the first hydraulic passageway in the shaft, the second hydraulic passageway communicating with the fluid loading means, a block mounted in the recessed portion of the arbor such that the arbor is rotatable with respect to the block, a third hydraulic passageway in the block and communicating with the first hydraulic passageway in the shaft, an annular gap between an inner surface of the block and an outer circumference of the shaft, and hermetic seal means in the annular gap for providing a hermetic seal between the shaft and the block when hydraulic fluid pressure is applied to the first, second and third hydraulic passageways.

18. The rolling apparatus of claim 17, wherein the shaft is fixedly mounted in the recessed portion such that the arbor and the shaft are not rotatable independently of each other.

19. The rolling apparatus of claim 17, wherein the block includes an inlet for supplying hydraulic fluid to the third hydraulic passageway.

20. The rolling apparatus of claim 9, wherein the first sleeve roll includes first projecting pieces extending in the axial direction from the axial end of the first sleeve roll, the first projecting pieces being separated by spaces which extend in a circumferential direction around the arbor, the first sleeve roll including an adjusting nut on which the first threads are provided, the first threads being threadedly engaged with the second threads of the width-adjusting sleeve, the adjusting nut including second projecting pieces extending in the axial direction, the second projecting pieces filling the spaces between the first projecting pieces, and circumferentially extending keys connecting the first and second projecting pieces together such that the adjusting nut and first sleeve roll move in the axial direction during adjustment of the first sleeve roll.

21. The rolling apparatus of claim 17, wherein the hermetic seal means comprises a plurality of distance pieces mounted in the annular gap and movable in the axial direction, the distance pieces being moved in the axial direction when hydraulic fluid pressure is applied to the first, second and third hydraulic passageways.

22. The rolling apparatus of claim 21, wherein the distance pieces include first and second tubular distance pieces adjacent to each other and surrounding the shaft, the hermetic seal means further including a tubular retainer in the annular gap and surrounding adjacent portions of the first and second tubular distance pieces.

* * * * *